United States Patent [19]

Kataoka et al.

[11] 4,092,222

[45] May 30, 1978

[54] TOP DUST COLLECTING APPARATUS IN COKE QUENCHING SYSTEM

[75] Inventors: Seiji Kataoka, Nohgata; Tutomu Shimizu; Kesao Katwuno, both of Kitakyushu, all of Japan

[73] Assignee: Nippon Steel Corporation, Otemachi, Japan

[21] Appl. No.: 758,783

[22] Filed: Jan. 12, 1977

[30] Foreign Application Priority Data

Jan. 14, 1976 Japan ..... 51-2035[U]

[51] Int. Cl.[2] ..... C10B 39/02

[52] U.S. Cl. ..... 202/227; 202/228; 202/263

[58] Field of Search ..... 202/227, 228, 262, 263; 201/39

[56] References Cited

U.S. PATENT DOCUMENTS

| | | | |
|---|---|---|---|
| 3,857,758 | 12/1974 | Mole | 202/263 X |
| 4,009,081 | 2/1977 | Ueda et al. | 202/263 X |

*Primary Examiner*—Morris O. Wolk
*Assistant Examiner*—Arnold Turk

[57] ABSTRACT

A coke dry quenching installation has a cooling chamber having a top charging opening, a travelling crane above the cooling chamber, and a coke bucket on the travelling crane movable to a position above the top charging opening and having a cover thereon. A hopper chute is positioned between the coke bucket and the top charging opening on the cooling chamber and is movable laterally toward and away from a position over the top charging opening, the hopper chute having a bottom opening which when the hopper chute is over the top charging opening is aligned in substantial gas tight alignment with the top charging opening. The coke bucket has a bottom opening which engages in sealing engagement with the top opening of the hopper chute when the coke bucket is lowered toward the cooling chamber by the travelling crane. A waste gas collecting system for the installation has a first dust collecting duct extending from the cover of the coke bucket laterally thereof, a second dust collection duct extending laterally from the hopper chute, a main dust collecting duct adjacent the cooling chamber, a first branch duct extending from the main duct and having a free end in a position where it is connected to the free end of said first duct when the coke bucket is in position on the hopper chute, and a second branch duct extending from the main duct and having a free end in a position where it is connected to the free end of the second duct when the hopper chute is in position over the top charging opening of the cooling chamber.

3 Claims, 2 Drawing Figures

TOP DUST COLLECTING APPARATUS IN COKE QUENCHING SYSTEM

BACKGROUND OF THE INVENTION

This invention relates to a dust collecting apparatus provided on the top portion of a cooling chamber of a dry quenching system in a coke manufacturing installation.

In a modern coke manufacturing process, a dry quenching method is used as one of the methods of quenching red hot coke. In this dry quenching method, the red hot coke discharged from a coke oven is charged into a cooling chamber which can be sealed, and is quenched and cooled while being shut off from the atmosphere. The charging of the red hot coke into the cooling chamber will be described in further detail. The red hot coke discharged from the coke oven is charged into a bucket hoisted by a hoist crane from a carrying car traveling horizontally on an elevated rail. The bucket filled with the red hot coke is shifted to a location immediately above a charge port provided on the top portion of the cooling chamber. The charge port of the cooling chamber is normally sealed by means of a chamber plug, but when the bucket approaches, the chamber plug is automatically removed, and immediately, a hopper chute is placed on the charge port. Then the bottom portion of the bucket is joined with the hopper chute, and the bottom portion of the bucket is opened so that the red hot coke is dropped into the cooling chamber through the hopper chute, whereby the cooling chamber is charged. The removal of the chamber plug and setting of the hopper chute on the charging port of the hopper chute are carried out automatically, and a large quantity of 10 - 20 tons of red hot coke can be charged in one operation into the cooling chamber in a short time. However, the charging of the red hot coke causes generation of dust or whirling of the floating dust due to a rising current of hot air after the charging, and solving of this problem is extremely important for the control of the environment. This problem is particularly great in the case of coke the carbonization of which is inappropriately carried out due to difficulties in the operation of the coke oven.

SUMMARY OF THE INVENTION

An object of the present invention is to provide an apparatus which is extremely simple and compact and is capable of collecting all of the dust which is generated without causing difficulty from the standpoint of installation and in which conventional stationary and movable parts are provided such as a fixed cooling chamber and a transfer bucket or hopper chute as described in the foregoing.

In order to achieve the foregoing object, top dust collecting apparatus coke dry quenching system according to the present invention is comprised of a duct on the hopper chute that extends in the advancing direction of the hopper chute as it moves into position on the cooling chamber, the duct having a connection portion on the free enb thereof, and an openable cover provided on the upper surface of the bucket, and a further duct is provided on the cover also extending in the direction in which the bucket advances into position on the cooling chamber and the front end thereof also having a connecting portion thereon. The apparatus further has a main dust collecting pipe in the vicinity of the cooling chamber and ducts are provided on the main pipe in positions which coincide with the positions of the free ends of the ducts on the hopper chute and the bucket, respectively, and which are connected to the duct on the hopper chute and the bucket respectively when the hopper chute and bucket are positioned immediately above the cooling chamber.

DESCRIPTION OF THE PREFERRED EMBODIMENT

Figure 1:
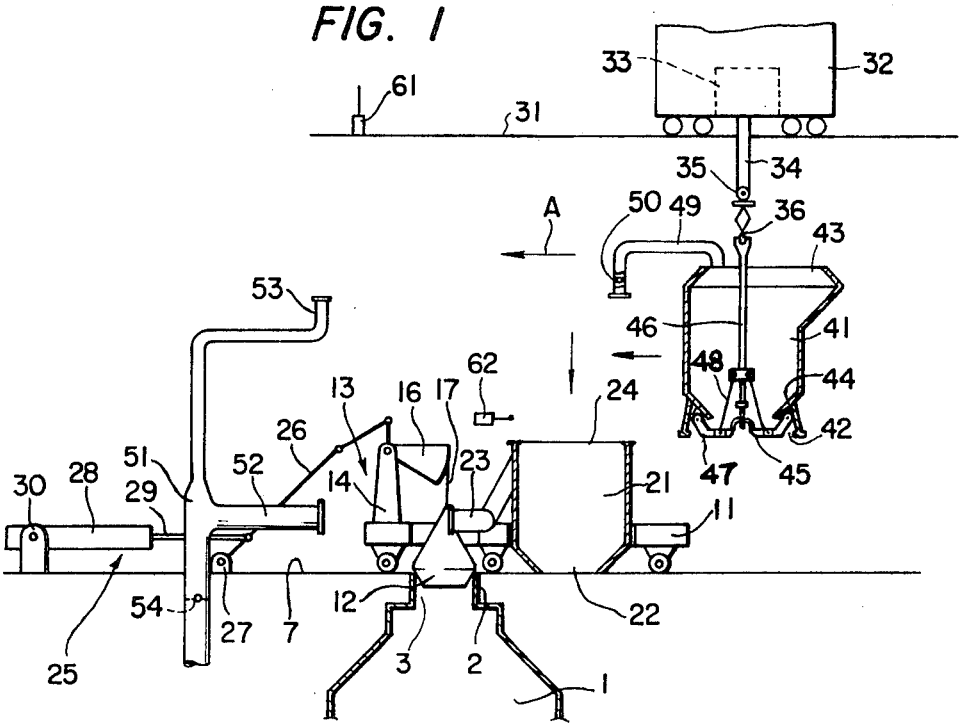
FIG. 1 is a schematic elevational view of a chamber top dust collecting apparatus for a coke dry quenching system according to the present invention, in which the charge port of the cooling chamber is closed by a chamber plug.
Figure 2:
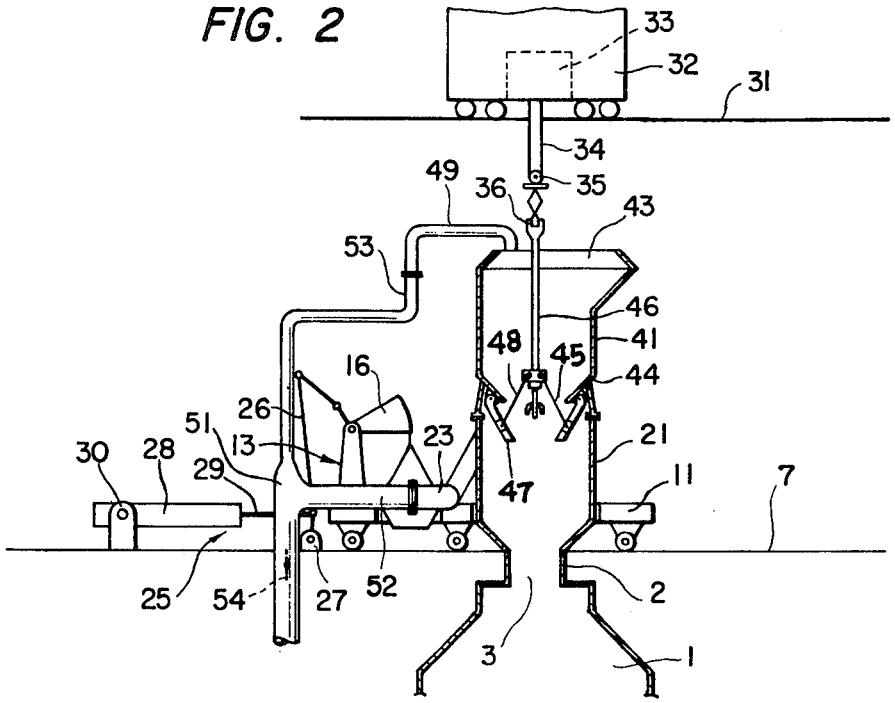
FIG. 2 is a view similar to FIG. 1 with the parts in position for charging red hot coke into the cooling chamber.

A cooling chamber 1 for housing and quenching and cooling red hot coke has a top 2 in a circular truncated cone shape, and a charge port 3 opens upwardly therefrom through a floor surface 7.

On the floor 7 surface is a charging car 11 which moves toward and away from the charge port 3 of the cooling chamber 1, and on the charging car 11 is a chamber plug 12 and a hopper chute 21 spaced in the traveling direction of car 11. The chamber plug 12 is for closing the charge port 3 of the cooling chamber 1, and is mounted on a plug moving device 13.

On a base 14 of the plug removing device 13 fixed on the charging car 11 is an arm having a fan-shape rotatably mounted around a horizontal aixs. One end of a rope 17 is fixed to the free end portion of the arm 16, and to the other end of the rope 17, a chamber plug 12 is fixed. The rope 17 is hoisted while being contacted by the arc-shaped surface of the tip of the arm 16 during the swinging motion of the arm 16 around the horizontal axis, or is lowered while separating from the arc-shaped surface. By the swinging operation of arm 16, the chamber plug 12 is lifted or lowered.

The hopper chute 21 is shaped such that its lower part is in the form of a funnel, and a discharge port 22 is provided at the lower end which skims the floor surface 7, and is arranged to coincide with the charge port 3 of the cooling chamber 1. A hopper duct 23 in communication with the inside of the hopper chute 21 is mounted near the upper end of the hopper chute 21. The hopper duct 23 extends horizontally and in the embodiment shown extends in the advancing direction (arrow A) of the charging car 11.

A driving apparatus 25 for moving the charging car 11 and the chamber plug 12 is provided with a linkage 26. One of the links of the linkage 26 is pivoted on a base 27 fixed on the floor 7, and the other link is pivoted on the arm 16. The one arm is connected with a piston rod 29 of a hydraulic cylinder 28 supported on a base 30. When the hydraulic cylinder 28 operates to move the piston rod 29 into the cylinder the charging car 11 moves forwards as the charging plug 12 is raised to open the charging port 3. When the hydraulic cylinder 28 operates to move the piston rod 29 out of the cylinder, the charging car 11 moves backwards as charging plug 12 descends to close the charging port 3.

Furthermore, an elevated rail 31 is installed above the cooling chamber 1, and a carrying car 32 is mounted on the elevated rail 31. A wire rope 34 from a hoist crane 33 hangs down from the bottom portion of the carrying car 32 and a bucket 41 is mounted on the lower end of the wire rope 34.

The bucket 41 is mountable on the hopper chute 21, and when the bucket 41 is mounted on the hopper chute 21, the opening 42 in the lower end of the bucket 41 coincides with the opening 24 on the upper end of the hopper chute 21, and the two openings communicate with each other. On the upper end of the bucket 41, an openable cover 43 is mounted, and a seat 44 having an opening 45, therein is provided towards the lower end thereof. The top of a suspending rod 46 is connected to a pulley block 35 engaged with the wire rope 34 of the hoist crane 33 through a connecting member 36. On the other hand, a gate 47 such as a doubleleafed hinged door is hinged on the seat 44 of the bucket 41 and is connected to the bottom of the suspending rod 46 by a rope 48. The port 45 of the bucket 41 is closed so long as the suspending rod 46 is in a raised position by virtue of the upward force applied by the hoist crane 33. When the force is released, the suspending rod 46 descends and the gate 47 opens allowing the red hot coke to fall into the cooling chamber 1.

Furthermore, on the cover 43 of the bucket 41 is a cover duct 49 in communication with the inside of the bucket 41. The cover duct 49 extends horizontally and in the embodiment shown extends in the advancing direction (arrow A) of the charging car 11. The free end of the cover duct 49 is bent downward and in the end of the cover duct 49 is a damper 50 which is normally closed.

A vertical main dust collecting pipe 51 is provided in the vicinity of cooling chamber 1, and has stationary ducts 52 and 53 which are at positions corresponding to the positions of ducts 23 and 49 when the hopper chute 21 and the bucket 41 are positioned above the cooling chamber 1. In the main dust collecting pipe 51 is a motor operated damper 54. In order to position the bucket 41 accurately during its travelling and lifting, a travelling detecting terminal 61 is provided on the elevated rail 31 of the carrying car 32 that supports the bucket 41, and a lifting detecting terminal 62 is provided on the upper end of the hopper chute 21.

The operation of the apparatus according to the present invention will be described in detail by referring to an example of actual manipulation thereof. The bucket 41 filled with red hot coke is hoisted by a crane 33 on the carrying car 32. At the same time as the hoisting of the crane, the driving apparatus of the charging car 11 and the charging device of the charging car 11 are driven and the charge port 3 is opened, and the hopper chute 21 is moved into charging position. At this stage, the hopper chute 21 is mounted on the cooling chamber, and the dust collecting duct 23 of the hopper chute portion is completely coupled with the stationary duct 52 and is ready for the charging operation. The coupling of the dust collecting duct 23 and the duct 52 can be positively carried out by a pressing force obtained from the driving device for the charging car 11 if an expansible flange structure with a built-in spring is provided on one of the ducts 23 and 52.

Next, the crane 33 for the carrying car 32 travels to a position over the center portion of the chamber 1 and stops when the crane contacts the detecting terminal 61, and the bucket 41 immediately. At this stage, the motor operated damper 54 is closed and the entrance of cold air is held to a minimum, and therefore the dust collecting power at other dust collecting locations (the location of each conveyor for delivery of cooled coke) is not impaired.

When the bucket descends and is set at a fixed position in the hopper chute, the coke is automatically discharged, and at the same time, the detecting terminal 62 is contacted and the operation of the crane 33 for the carrying car 32 stops and the motor operated damper 54 is opened. Also, during the descending of the bucket, the dust collecting the duct 49 on the top cover portion is coupled with the duct 53 and the damper 50 is mechanically opened and the dust collecting starts immediately. The coupling of the top cover dust collecting duct 49 and the stationary duct 53 can be positively carried out by the pressing force caused by the downward movement of the bucket if an expansible flange structure is provided on one of the ducts.

The apparatus of the present invention is extremely effective since the dust from the red hot coke charged into the cooling chamber 1 can be collected with a compact structure which does not interfere in the conventional installation.

What is claimed is:

1. A coke dry quenching installation comprising:
a cooling chamber having a top charging opening;
a travelling crane above said cooling chamber;
a coke bucket on said travelling crane movable by said travelling crane to a position above said top charging opening and having a cover thereon;
a hopper chute between said coke bucket and said top charging opening on said cooling chamber and movable laterally toward and away from a position over said top charging opening, said hopper chute having a bottom opening which when the hopper chute is over the top charging opening is aligned in substantial gas tight alignment with said top charging opening and having a top opening, said coke bucket having a bottom opening which engages in sealing engagement with the top opening of said hopper chute when said coke bucket is lowered toward said cooling chamber by said travelling crane, and said coke bucket having a gate therewithin immediately above the bottom opening thereof which is automatically openable when said coke bucket is lowered onto said hopper chute; and
a waste gas collecting means for said installation, consisting of a first dust collecting duct extending from the cover of said coke bucket laterally thereof, a second dust collecting duct extending laterally from said hopper chute, a main dust collecting duct adjacent said cooling chamber, a first branch duct extending from said main duct and having a free end in a position where it is engaged by the free end of said first duct for connection thereto by the movement of said coke bucket into position on said hopper chute when said hopper chute is in position over said top charging opening, and a second duct extending from said main duct and having a free end in a position where it is connected to the free end of said second duct when said hopper chute is in position over said top charging opening of said cooling chamber.

2. A coke dry quenching installation as claimed in claim 1 in which said first dust collecting duct has the free end thereof bent downwardly and the free end of said first branch duct is bent upwardly, the said free ends being positioned for being in pressure contact when the coke bucket is in position on said hopper chute.

3. A coke dry quenching installation as claimed in claim 1 in which the free end of said second dust collecting duct and the free end of said second branch duct are positioned for being in pressure contact when the hopper chute is in position over said top charging opening.

* * * * *